US007380307B2

(12) United States Patent
Tsai

(10) Patent No.: US 7,380,307 B2
(45) Date of Patent: Jun. 3, 2008

(54) STEAM CLEANING DEVICE

(76) Inventor: Mei-Hua Tsai, 4F., No. 14, Lane 379, ChungMei Street, Taichung City (TW)

( * ) Notice: Subject to any disclaimer, the term of this patent is extended or adjusted under 35 U.S.C. 154(b) by 0 days.

(21) Appl. No.: 11/338,704

(22) Filed: Jan. 25, 2006

(65) Prior Publication Data

US 2007/0169304 A1 Jul. 26, 2007

(51) Int. Cl.
*A47L 7/00* (2006.01)

(52) U.S. Cl. ..... 15/320; 15/322; 15/344; 392/333

(58) Field of Classification Search ..... None
See application file for complete search history.

(56) References Cited

U.S. PATENT DOCUMENTS 6,289,551 B1 * 9/2001 Basile ..... 15/320
6,490,753 B1 * 12/2002 Chen ..... 15/320
6,895,626 B2 * 5/2005 Tsai ..... 15/50.1

* cited by examiner

*Primary Examiner*—David A Redding
(74) *Attorney, Agent, or Firm*—Rabin & Berdo, P.C.

(57) ABSTRACT

The present invention provides an improved steam cleaning device, comprising: a hand-held steam generator, a pole, a platform cleaning polygon housing, constructed by an upper lid and a lower lid opposite to each other, a steam-releasing apparatus disposed at the bottom of the platform cleaning polygon housing, indentation of the upper lid pivoted to clips, at least one wheeled body connected to lift said platform cleaning polygon housing off the floor; and a cleaning tool; wherein said hand-held steam generator can be selectively adapted to the pole, the platform cleaning polygon housing or at least one cleaning tool.

14 Claims, 15 Drawing Sheets

STEAM CLEANING DEVICE

BACKGROUND OF THE INVENTION

1. Field of the Invention

The present invention relates to an improved steam cleaning device, particularly to an improved steam cleaning device that is easy to assemble, operate and sterilize.

2. Description of the Related Art

The U.S. published application No. 20040031506 "Retaining device for a steam swab" disclosed a steam swab firmly secured fabric at all sides and even though a boiler directly added to the steam cleaning machine to provide with high temperature steam. However, the complicated structure of the steam swab is not easy to assemble, and increases unexpected expense with its complexity. Moreover, this conventional steam swab is only suitable for the plain place.

In view of the shortcomings of said known device, the inventor of the present invention studied hard and devised an improved steam cleaning device.

SUMMARY OF THE INVENTION

Accordingly, an object of the present invention is to provide an improved steam cleaning device, comprising: a steam generator, a pole, a platform cleaning polygon housing, and at least a cleaning tool, wherein the platform cleaning polygon housing could be triangular or tetragonal, the cleaning tool could be jetting nozzles, a circular brush, a triangular brush, a glass scraper, or an implanted brush, and said steam generator could be selectively used alone, or adapted to the pole, the platform cleaning polygon housing or cleaning tool.

To achieve the above objects, the invention is to provide an improved steam cleaning device, comprising: a hand-held steam generator, a pole, a platform cleaning polygon housing, and one or more cleaning tools, wherein said hand-held steam generator can be selectively used alone, or adapted to the pole, the platform cleaning polygon housing or at least one cleaning tool, and said platform cleaning polygon housing is constructed by an upper lid and a lower lid opposite to each other, a steam-releasing apparatus disposed on the bottom of the platform cleaning polygon housing, indentation of the upper lid pivoted to clips, at least one wheeled body connected to lift said platform cleaning polygon housing off the floor. Moreover, the pole can be assembled by multi-section annular tubes and plugged into the steam generator at the top end.

The hand-held steam generator comprises a handle grip, a liquid reservoir, a bottom casing, a PCB main board, a water pump, a heating element, a temperature control device, silica gel tubes and an inner nozzle. There are further included a vapor adjustment knob and a switch button settled on the shell of the handle grip, and a liquid reservoir knob deposed on the shell of the liquid reservoir.

The platform cleaning polygon housing further includes a plurality of clips traversed on the indentation to secure a removable fabric/cloth to the platform cleaning polygon housing. Since the fabric/cloth is removable, it is more easily to clean the floor surface when soaked with soil material. A plurality of elastic components is settled between the platform cleaning polygon housing and the clips, to restore the clips to clamp closely the fabric. Further, a plurality of holding fittings can be disposed on the relative surfaces of the clips and indentation of the platform cleaning polygon housing, improving the holding power when clips grasped the fabric.

Furthermore, at least one wheeled body is fitted into an appropriate position of the platform cleaning polygon housing to facilitate its sliding over the floor surface, and to lift the platform cleaning polygon housing off the floor. A plurality of friction components is deposed on the bottom of the platform cleaning polygon housing to prevent from sliding away.

In addition, the users can utilize the steam cleaning device to clean all kinds of materials with any angle environment more efficiency by adjusting the steam output and pressure, for example, users can apply dry steam- small amount steam, to clean wooden floor; moreover, the cleaning device also provides the sterilization function by high temperature of steam.

For a further understanding of the nature and advance of the invention, reference should be made to the following description in conjunction with the accompany drawings.

BRIEF DESCRIPTION OF THE DRAWINGS

These objects and other objects and advantages of the present invention will become more apparent upon reading of the following detailed description and the accompanying drawings in which.

DETAILED DESCRIPTION OF A PREFERRED EMBODIMENT

The foregoing and other objects, features and advantages of the present invention will be more readily understood upon consideration of the following detailed first and second preferred embodiment's description of the invention, taken in conjunction with the following drawing.

Figure 1:
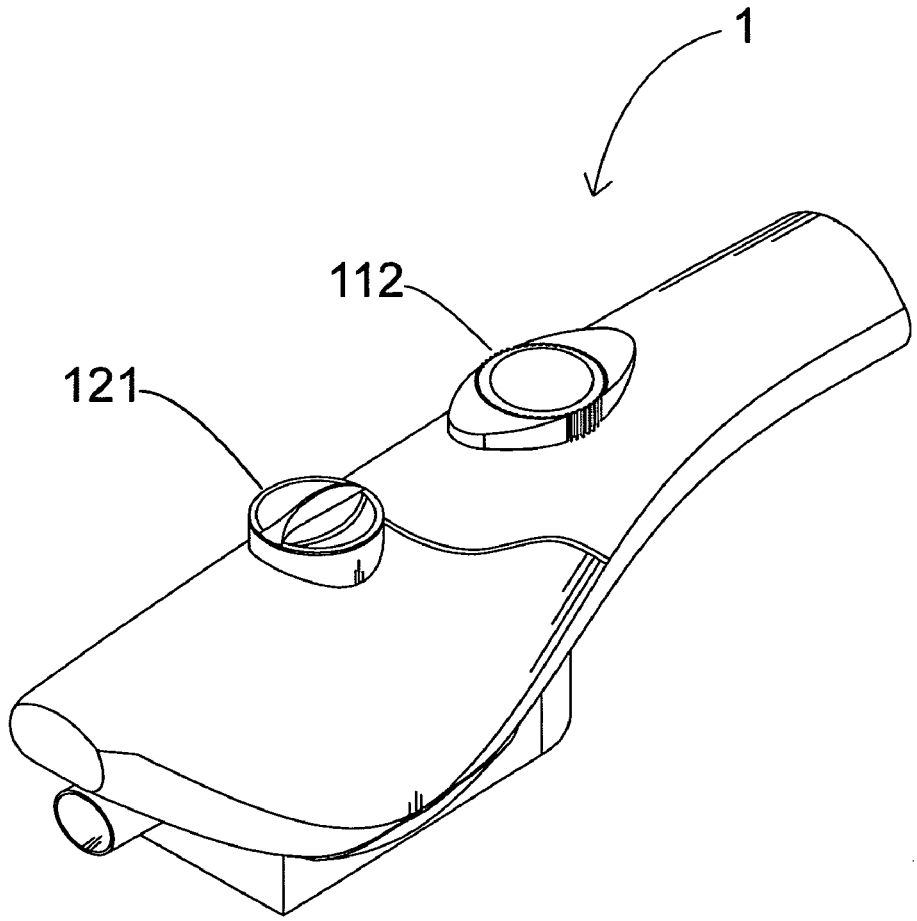
FIG. 1 is a perspective view of a hand-held steam generator of the first embodiment according to the invention.

FIGS. 1-7 show the first embodiment of the invention. The invention provides an improved steam cleaning device, comprising: a steam generator 1, a pole 2, a platform cleaning polygon housing 3, and at least a cleaning tool 5, wherein the platform cleaning polygon housing 3 is triangular. FIG. 1. is a perspective view of a hand-held steam generator 1; there are one liquid reservoir knob 121 and one steam adjustment knob 112 deposed on the shell of the hand-held steam generator 1. The steam adjustment knob 112 could also regulate the flow rate of steam jetting from the steam generator 1, wherein the steam rate is 24-45.0±5 CC/min. The hand-held steam generator 1 can be used alone.

Figure 2:
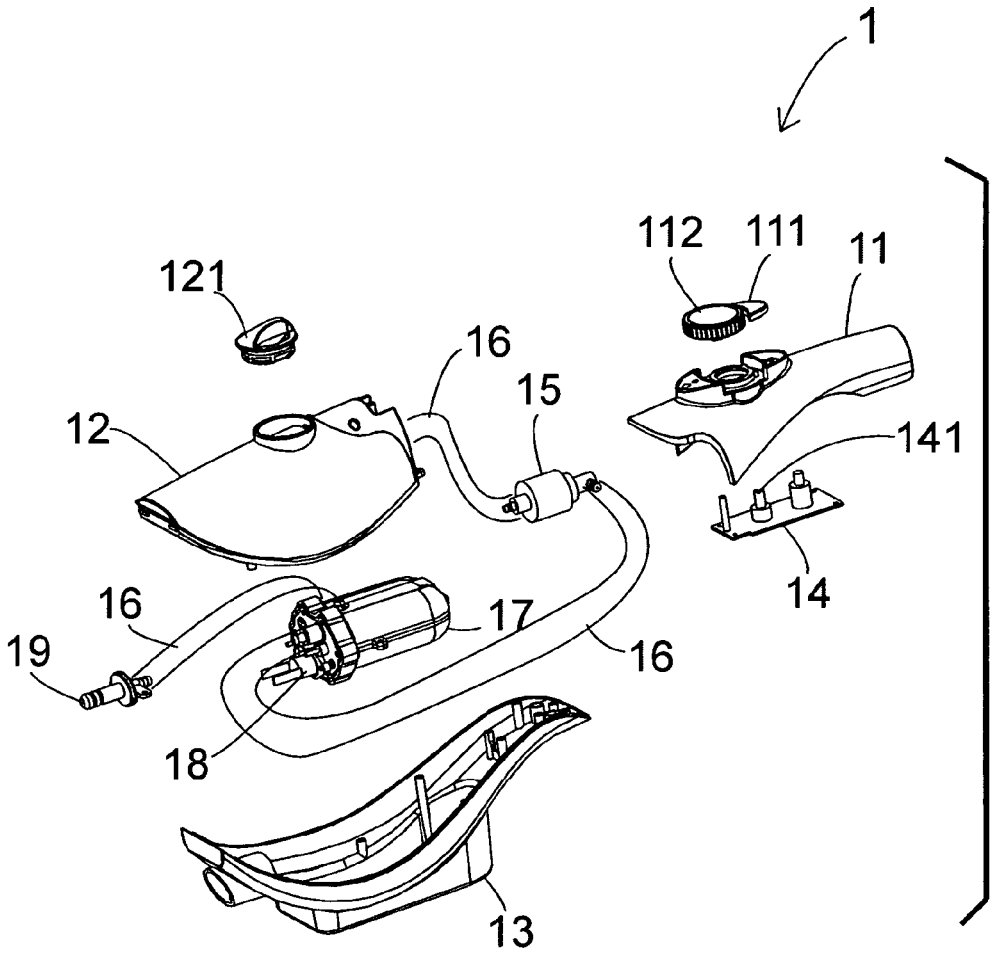
FIG. 2 is a schematic view of a hand-held steam generator of the first embodiment according to the invention.

FIG. 2 is a schematic view of a hand-held steam generator of the first embodiment according to the invention. The hand-held steam generator 1 further comprises a handle grip 11, a liquid reservoir 12, a bottom casing 13, a PCB main board 14, a water pump 15, a heating element 17, a temperature control device 18, silica gel tubes 16 and a inner nozzle 19. The vapor adjustment knob 112 and the switch button 111 is settled on the handle grip 11. The liquid reservoir knob 121 is deposed on the liquid reservoir 12. After adding water to the liquid reservoir 12, an actuation mechanism regulates the potentiometer 141 of the PCB main board 14, controls the amount from the water pump 15, dispenses water into the heating element 17, and produces the steam instantaneously; the vaporized water is jetted out from the inner nozzle 19, and adjustment knob 112 is used to modulate to control the steam-jetting amount.

Selectively, the hand-held generator 1 can mount a pole 2 or cleaning tools 5 on its top end or on its bottom end. The cleaning tools 5 could be jetting nozzles, a circular brush, a triangular brush, a glass scraper, and an implanted brush. By regulating the amount of produced steam jetted out from the inner nozzle of the hand-held steam generator, users can utilize the cleaning device more easily and effortlessly for any environment conditions or demands, such as the small amount dry steam is good for to clean wooden floor.

Figure 3A:
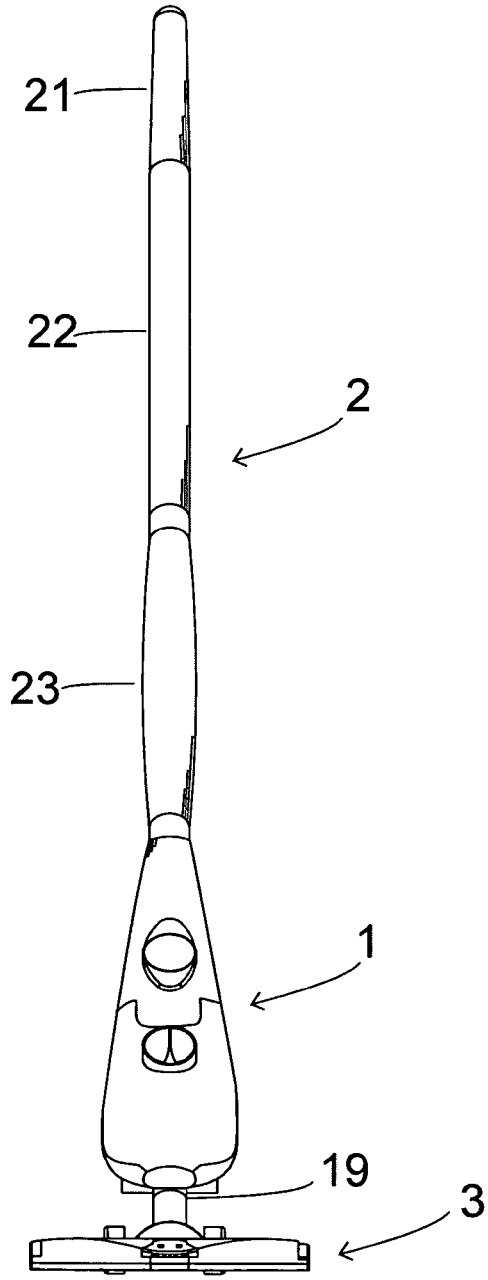
FIG. 3A is a perspective front view of a complex of a pole, a steam generator and platform cleaning polygon housing of the first embodiment according to the invention.
Figure 3B:
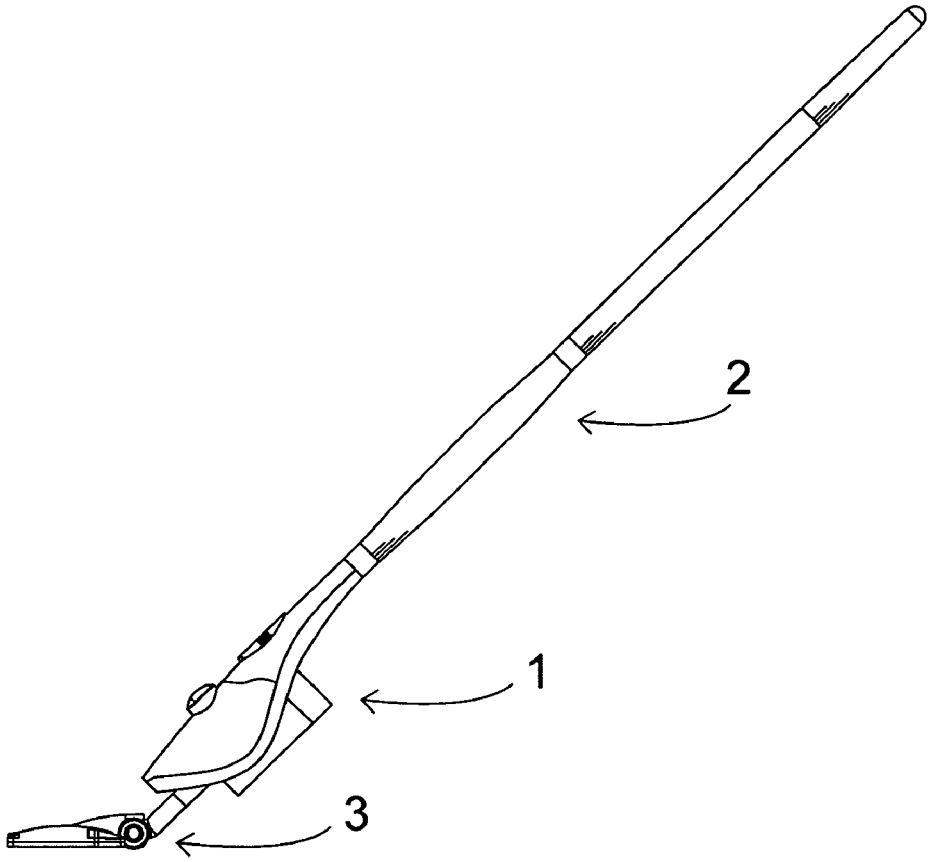
FIG. 3B is a perspective side view of a complex of a pole, a steam generator and platform cleaning polygon housing of the first embodiment according to the invention.
Figure 3C:
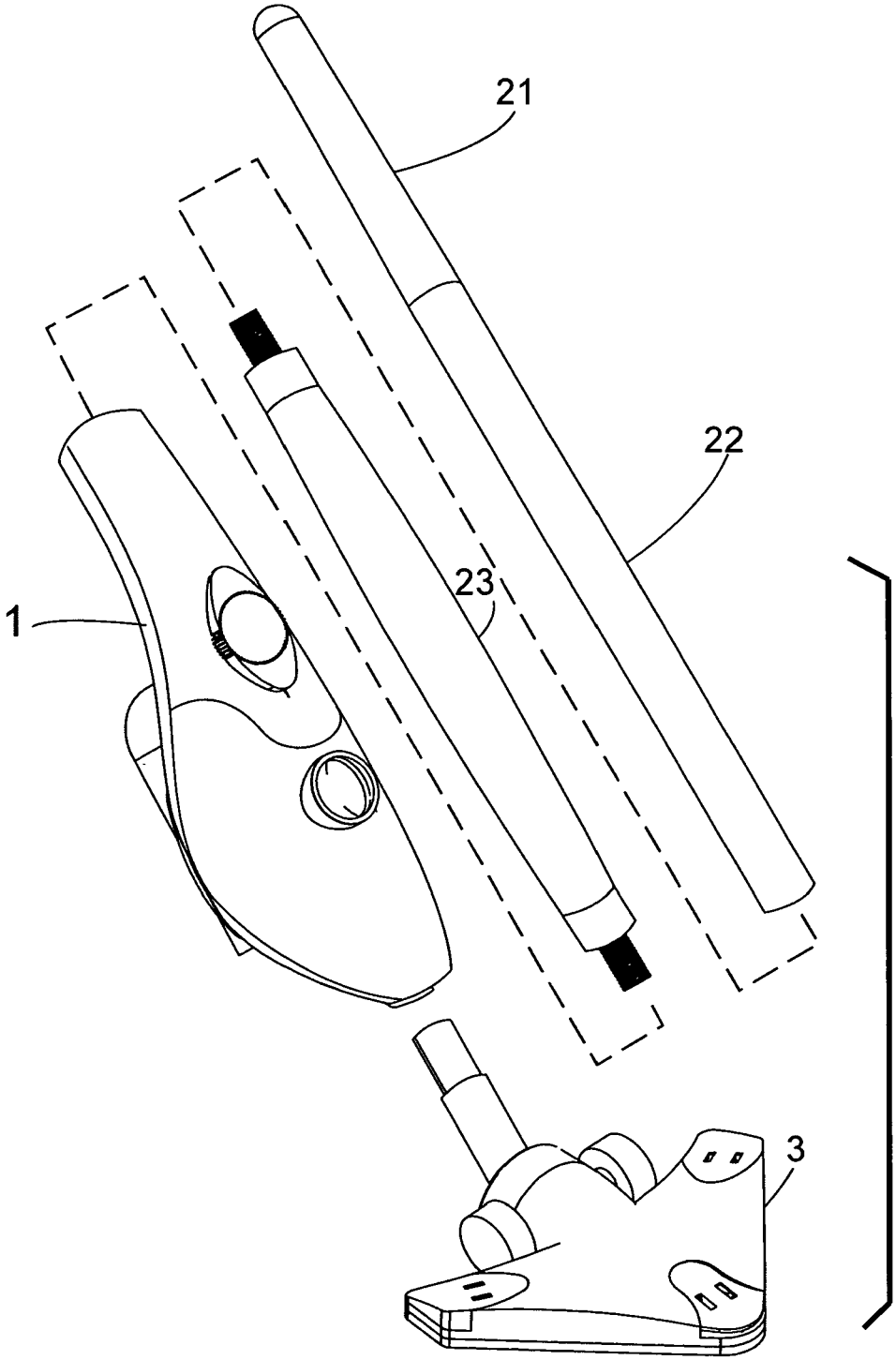
FIG. 3C is an analytic view of a complex of a pole, a steam generator and a platform cleaning polygon housing of the first embodiment according to the invention.

With reference to FIG. 3A, FIG. 3B, and FIG. 3C, respectively illustrating a front perspective view, a perspective side view, and an analytic view of a complex of a pole, a steam generator and platform cleaning polygon housing of the first embodiment according to the invention. A complex is a multi-form that is constructed by a steam generator 1, a pole 2 and a platform cleaning polygon housing 3. The pole 2 is a longitudinal axis that is an order connection comprising a grip 21, a first angular tube 22 and a second angular tube 23, wherein the grip 21 exhibits a corrugated shape in order to correspond with the physical performance of human hands, and the second annular tube 23 is a shape of circle arc to facilitate a user's holding. The platform cleaning polygon housing 3 is plugged into the relative position of the inner nozzle 19 of the hand-held steam generator 1.

Figure 4A:
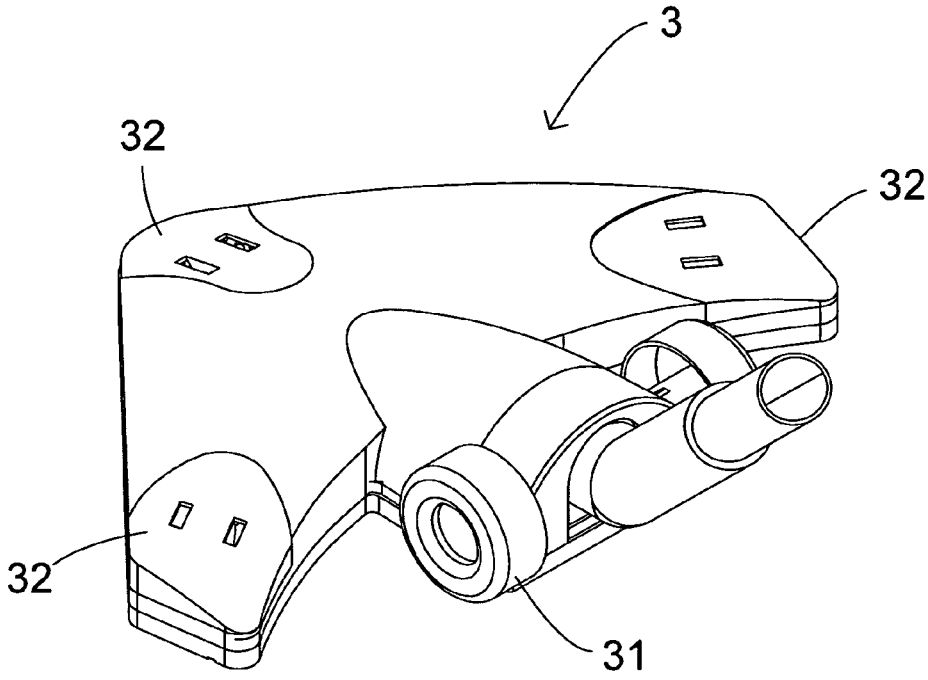
FIG. 4A is a perspective view of a platform cleaning polygon housing of the first embodiment according to the invention.
Figure 4B:
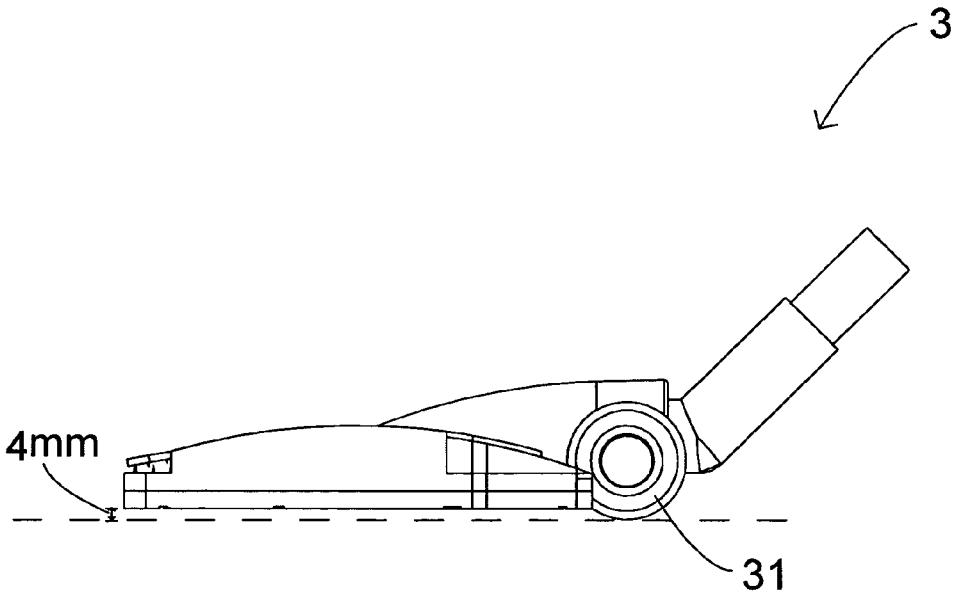
FIG. 4B is a perspective side view of a platform cleaning polygon housing of the first embodiment according to the invention.

Referring to FIG. 4A and FIG. 4B, respectively illustrating a perspective view and a perspective side view of a platform cleaning polygon housing of the first embodiment according to the invention. In first embodiment, the platform cleaning polygon housing 3 is triangular housing, wheeled body 31 settled at its proper rear position. In addition, the wheeled body 31 is to facilitate its sliding over the floor surface, wherein the distance off the floor of the platform cleaning polygon housing is 4 mm.

Figure 5A:
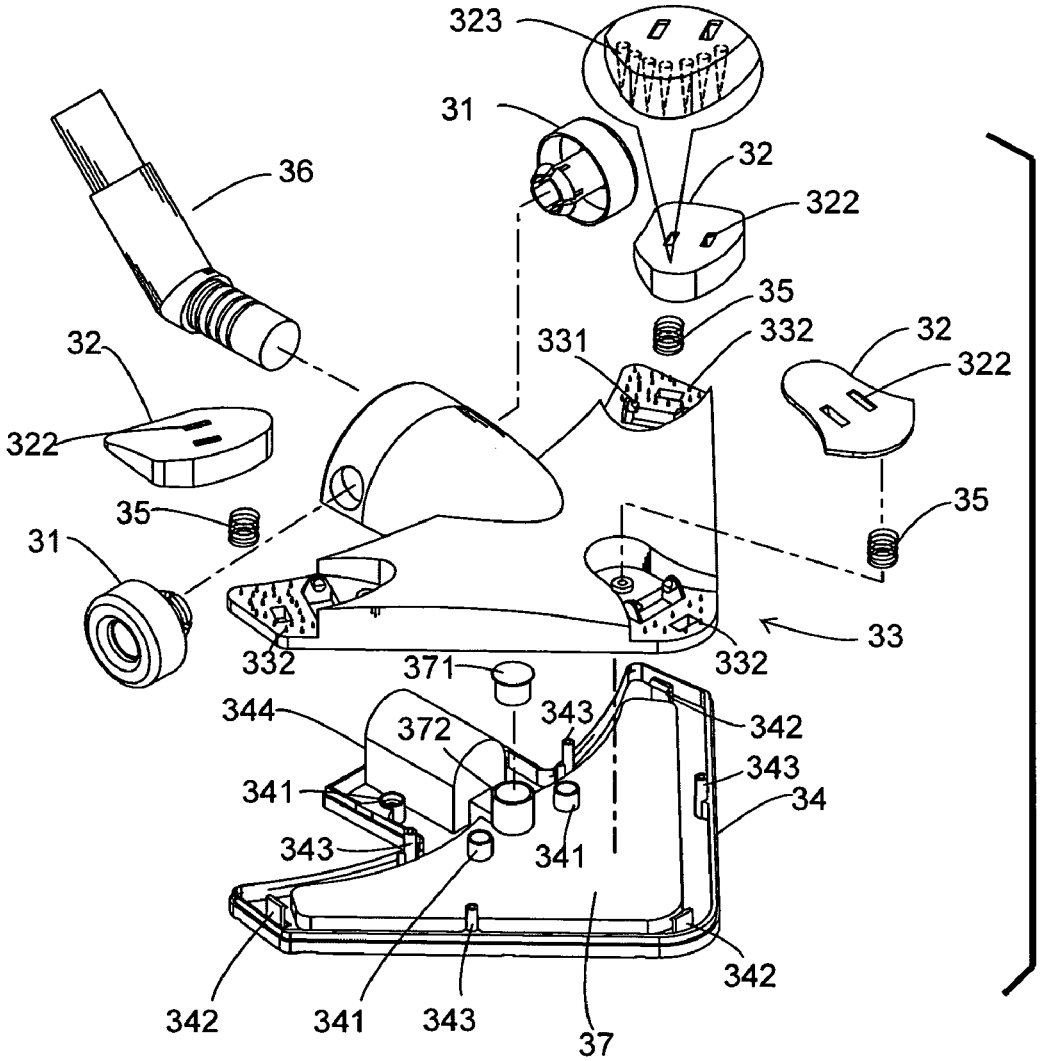
FIG. 5A is an exploded view of a platform cleaning polygon housing of the first embodiment according to the invention.
Figure 5B:
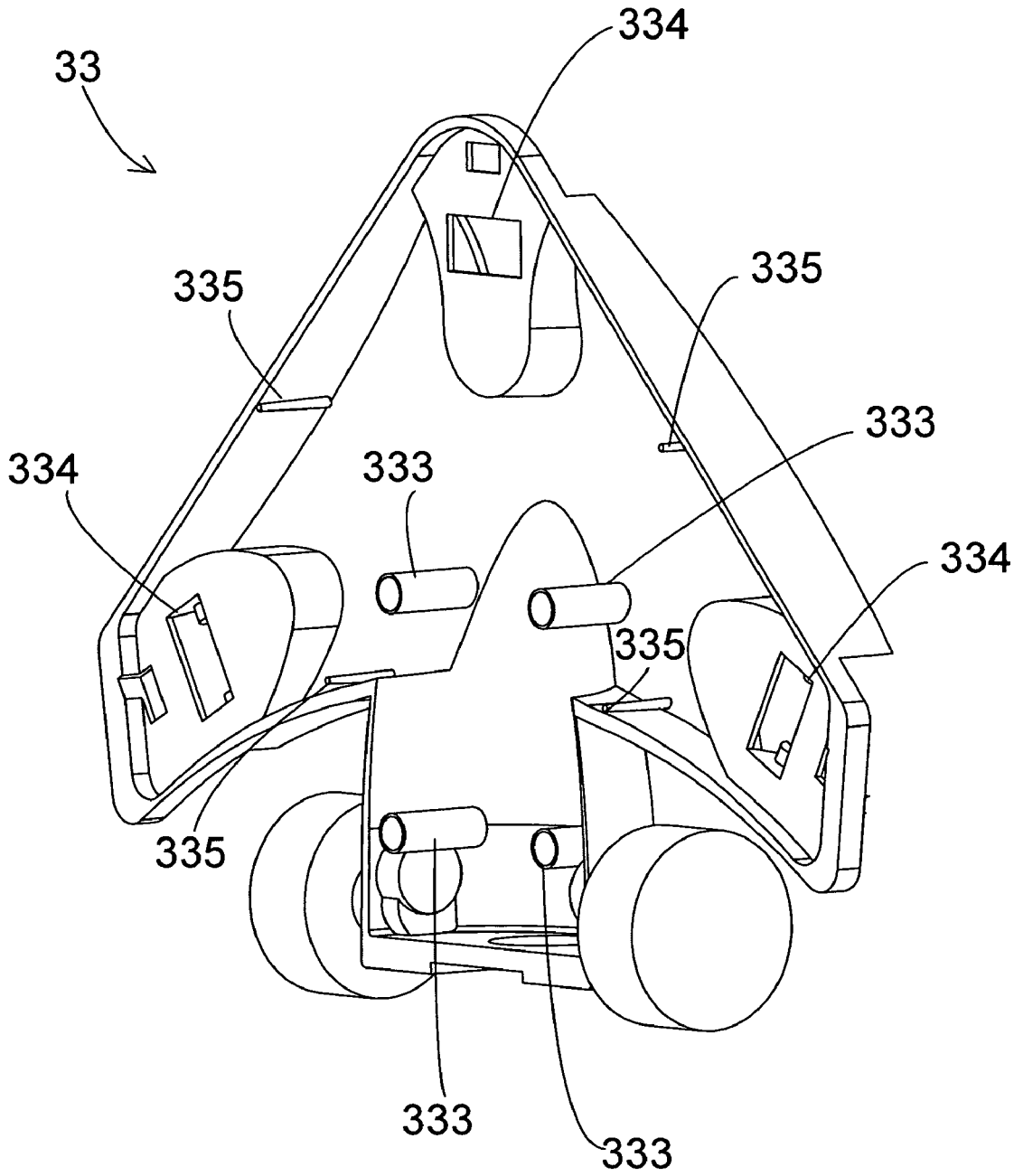
FIG. 5B is a bottom view of the upper lid of the first embodiment according to the invention.
Figure 6:
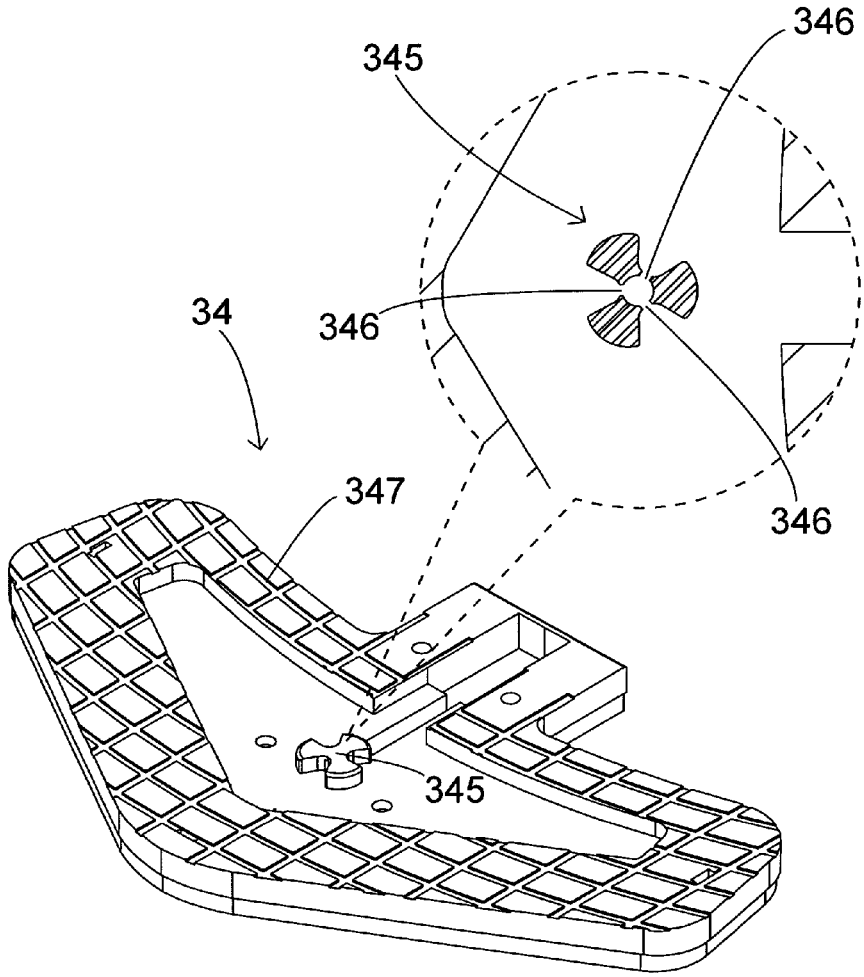
FIG. 6 is a bottom view of the lower lid of the first embodiment according to the invention.

With reference to FIG. 5A, FIG. 5B and FIG. 6, respectively illustrating an analytic view of a platform cleaning polygon housing, a bottom view of the triangular upper lid, and a bottom view of the lower lid of the first embodiment according to the invention. The platform cleaning polygon housing 3 comprises at least four parts: an upper lid 33, a lower lid 34, clips 32 and wheeled bodies 31, wherein the wheeled bodies 31 are operatively connected to the triangular upper lid 33, and the clips 32 are fastened to indentation disposed at vertex of the triangular upper lid 33 by anchoring sections 331, which hook correspondent latch sections 322 deposed on the clips 32. The clips 32 are to secure an absorbent cloth 321 to the platform cleaning polygon housing 3. Since the absorbent cloth 321 is removable, it is easily cleaned when saturated with soil material. A plurality of springs 35 settled between the triangular upper lid 33 and the clips 32, so the clips 32 can restore to closely clamp the absorbent cloth 321. Tack-type bunches 323 and 332 are disposed on the bottom of the clips 32 and on the indentation of the triangular upper lid 33.

In FIG. 5A, the triangular upper and lower lid 33, 34 opposite to each other in a length direction assemble the platform cleaning polygon housing, with an intermediate accommodation chamber being interposed there between. For orientating the triangular upper and lower lids 33, 34, a plurality of orientating pillars 341 located on the lower lid 34 are connected to orientating pillars 333 located on the undersurface of the triangular upper lid 33. In order to firmly secure the triangular upper and lower lid 33, 34, fasteners 342 and latch sections 343 disposed on the upwards-surface of the triangular lower lid 34 are respectively pivoted into fastener-receivers 334 and anchoring sections 335 disposed on the undersurface of the triangular upper lid 33.

Moreover, the rear portion of the triangular lower lid 34 is one steam-conducting cell 344, which defines an opening that communicates the platform cleaning polygon housing 3 with the hand-held steam generator 1. To one end of the steam-conducting cell 344 is connected one pivotal shaft 36 in a pivotal engaging relationship, and to the other end of the steam-conducting cell 344 is connected one high-temperature resistant chamber 37 at front portion of the triangular lower lid 34, the pivotal shaft also pivoted to the bottom of the steam generator 1 in a pivotal engaging relationship. Thereby, whether the pole 2 or the steam generator 1 a user holds may be pivotally turned in a proper angle around the pivotal shaft 36 functioning as a fulcrum so that a user can maneuver the platform cleaning polygon housing 3 conveniently. The high-temperature resistant chamber 37, which confines a steam passage, comprises a plurality of holes open outwards to release steam conducted from the steam generator 1.

Referring to FIG. 6, three steam-jetting holes 346 deposed in a steam-releasing apparatus 345 located on the bottom of the lower lid 34, direct the steam released from high temperature resistant chamber 37 out to the air. A centrally triangular indentation is disposed on the bottom of the triangular lower lid 34 to collect jet out steam. A plurality of grooves 347 is deposed on the bottom of the triangular lower lid 34. Moreover, an outlet 372 may be disposed on the surface of the high temperature resistant chamber 37, with a steam plug 371 sealing the outlet 372 ordinarily.

Figure 7:
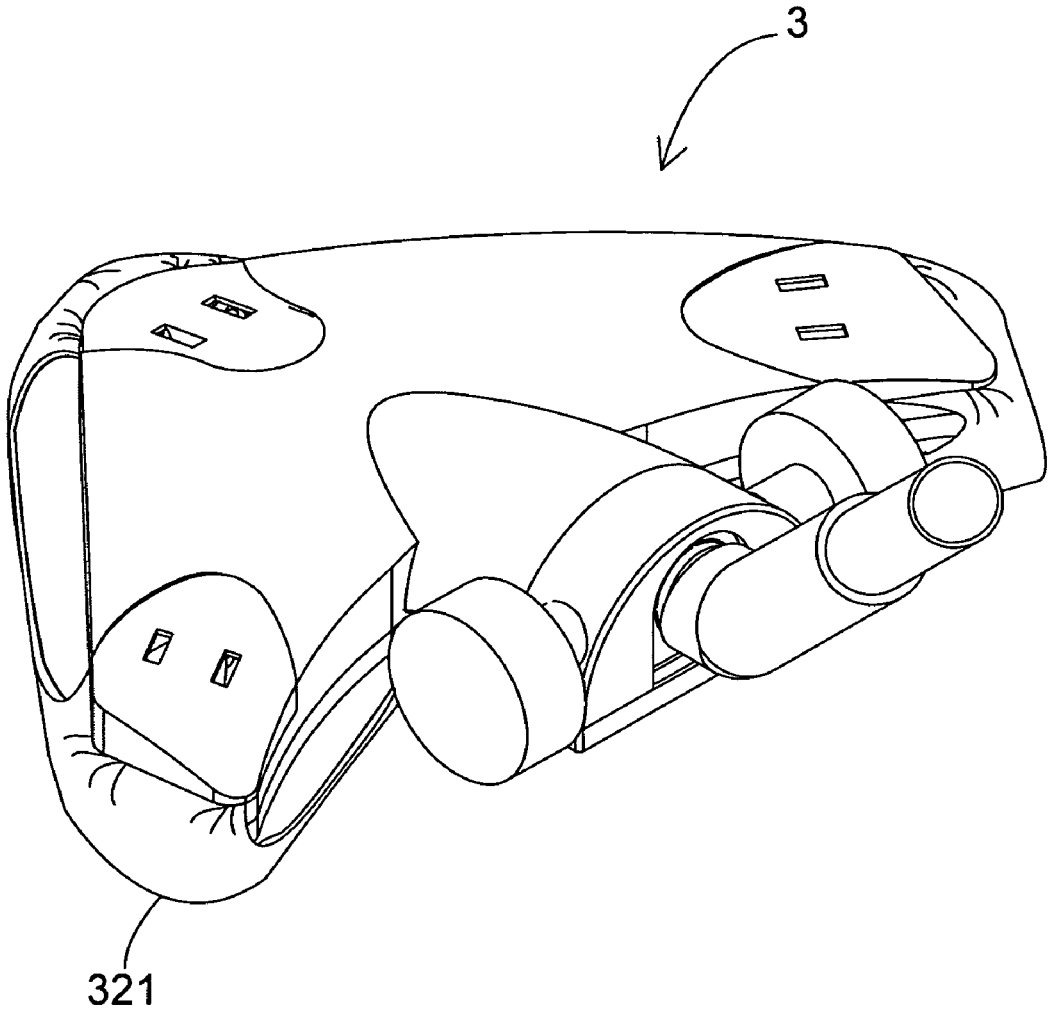
FIG. 7 is a view of clips' clamping ion of a platform cleaning polygon housing of the first embodiment according to the invention.
Figure 8:
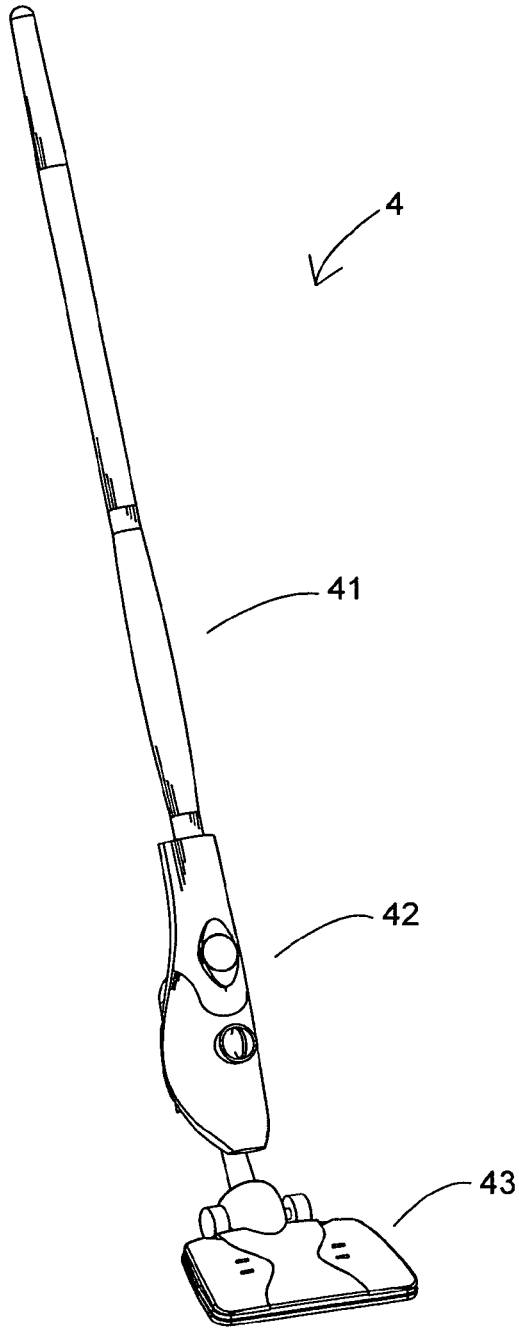
FIG. 8 is a perspective view of the second embodiment according to the invention.
Figure 9:
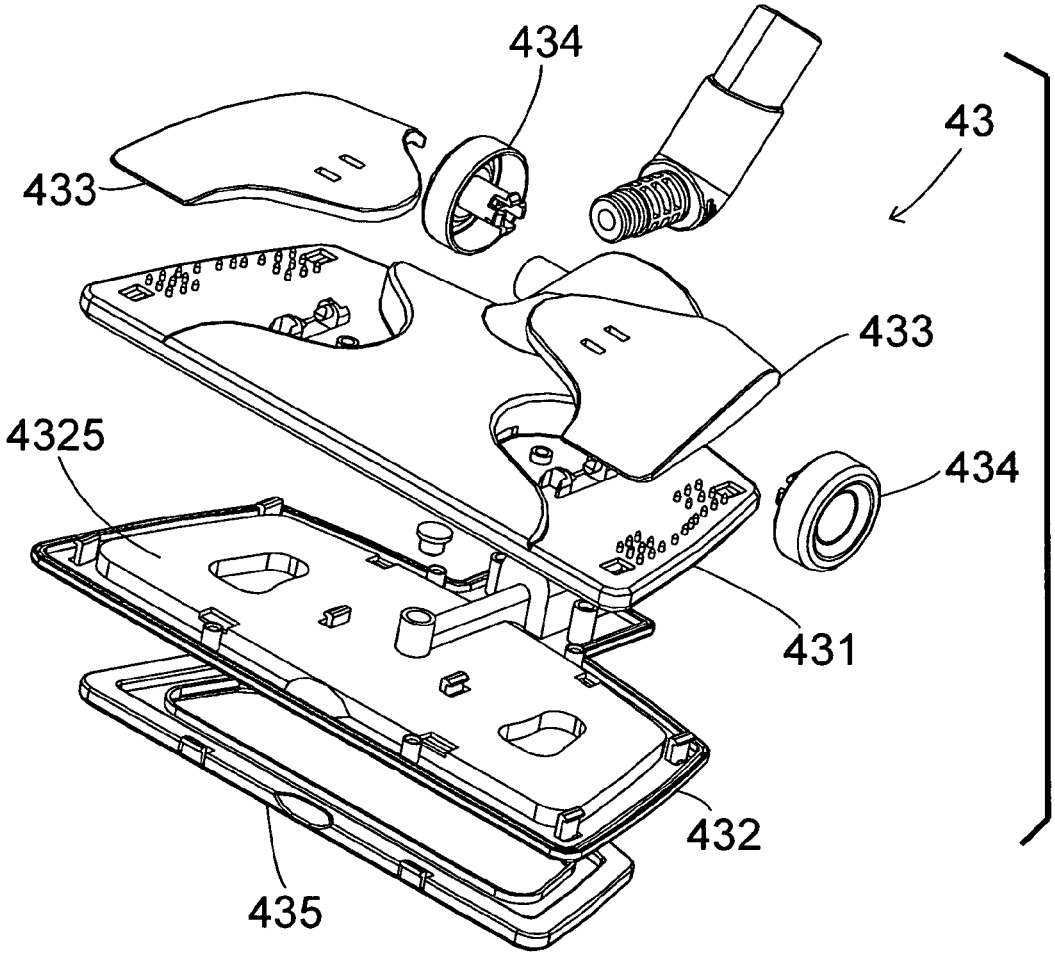
FIG. 9 is a perspective analytic view of a platform cleaning polygon housing of the second embodiment according to the invention.

FIG. 7, is a view of clips' clamping ion of a platform cleaning polygon housing of the first embodiment according to the invention. As shown in the drawing, the wet absorbent cloth 321 could clean and remove dusts by an attachment of steam molecules to dust molecules, making cleaning more convenient and easier.

Figure 12:
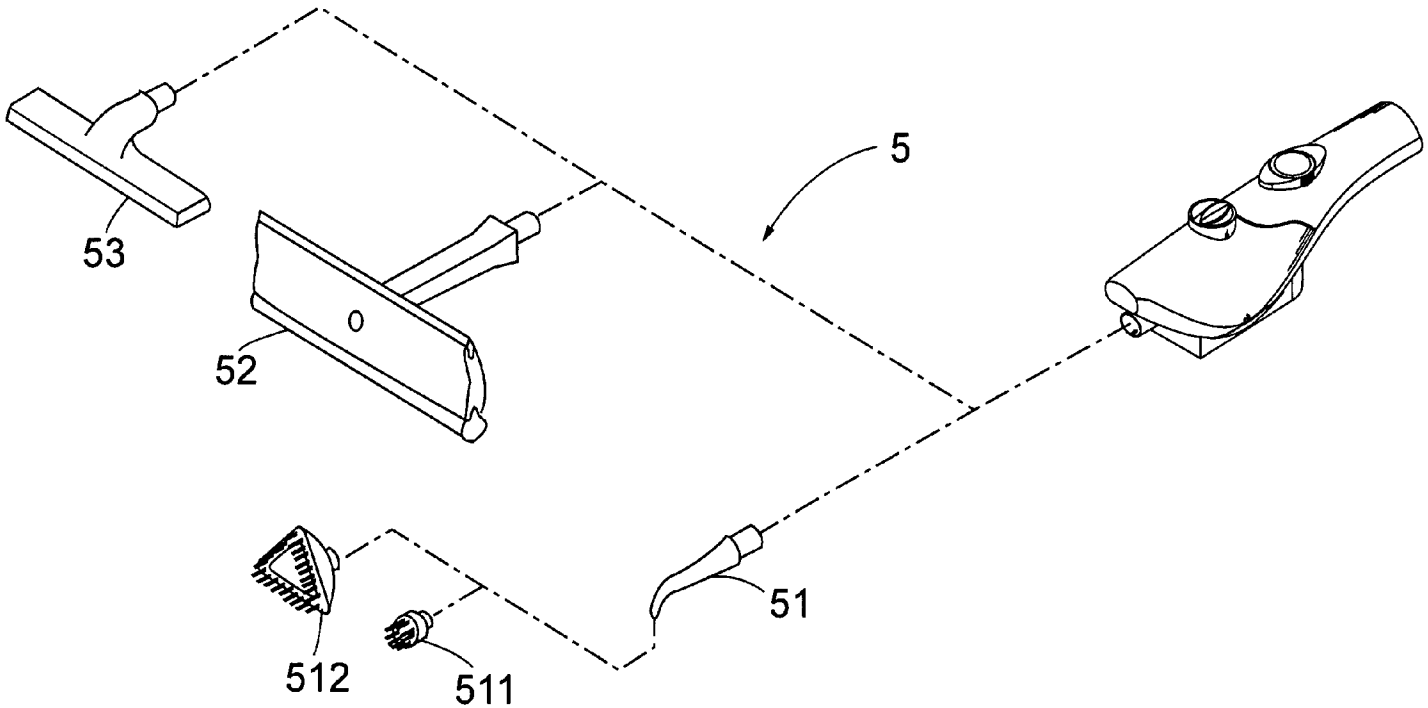
FIG. 12 shows the cleaning tools engaged to the hand-held steam generator of the invention.

To sum up, FIGS. 1-7 show the first embodiment of the invention, FIGS. 8-11 show the second embodiment of the invention, and FIG. 12 shows the cleaning tools engaged to the hand-held steam generator of the first and the second embodiment. The structure of the second embodiment is almost identical to the first embodiment.

Next, referred to FIG. 8, FIG. 9, FIG. 10 and FIG. 11, respectively illustrating a perspective view, an analytic perspective view of a platform cleaning polygon housing, a bottom view of the bottom housing, and a view of clips' clamping ion of a platform cleaning polygon housing of the second embodiment according to the invention. The second embodiment also disclosed an improved steam cleaning device 4, comprising: a hand-held steam generator 42, a pole 42, a platform cleaning polygon housing 43, and at least a cleaning tool 5, wherein the platform cleaning polygon housing 43 is tetragonal.

The platform cleaning polygon housing 43 comprises at least four-parts: one tetragonal upper 431, one tetragonal lower lid 432, clips 433, and two wheeled body 434, wherein the two wheeled bodies 434 are operatively connected to the tetragonal upper lid 433, and the clips 433 are fastened to indentation disposed at the both wide sides of a tetragon of the tetragonal upper lid 433. The clips 433 are provided to clamp one absorbent cloth 4331.

Figure 10:
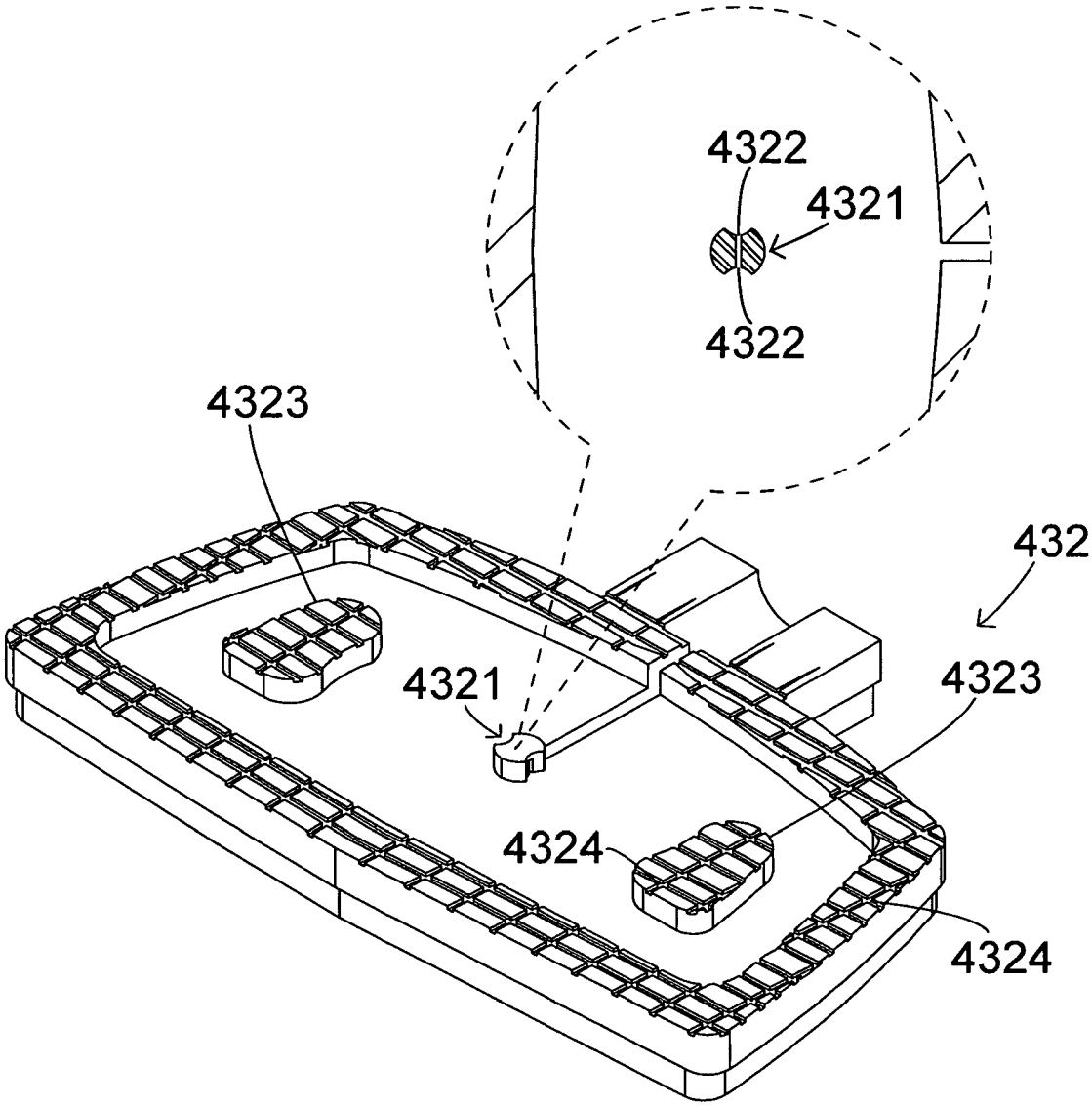
FIG. 10 is a bottom view of the lower lid of the second embodiment according to the invention.
Figure 11:
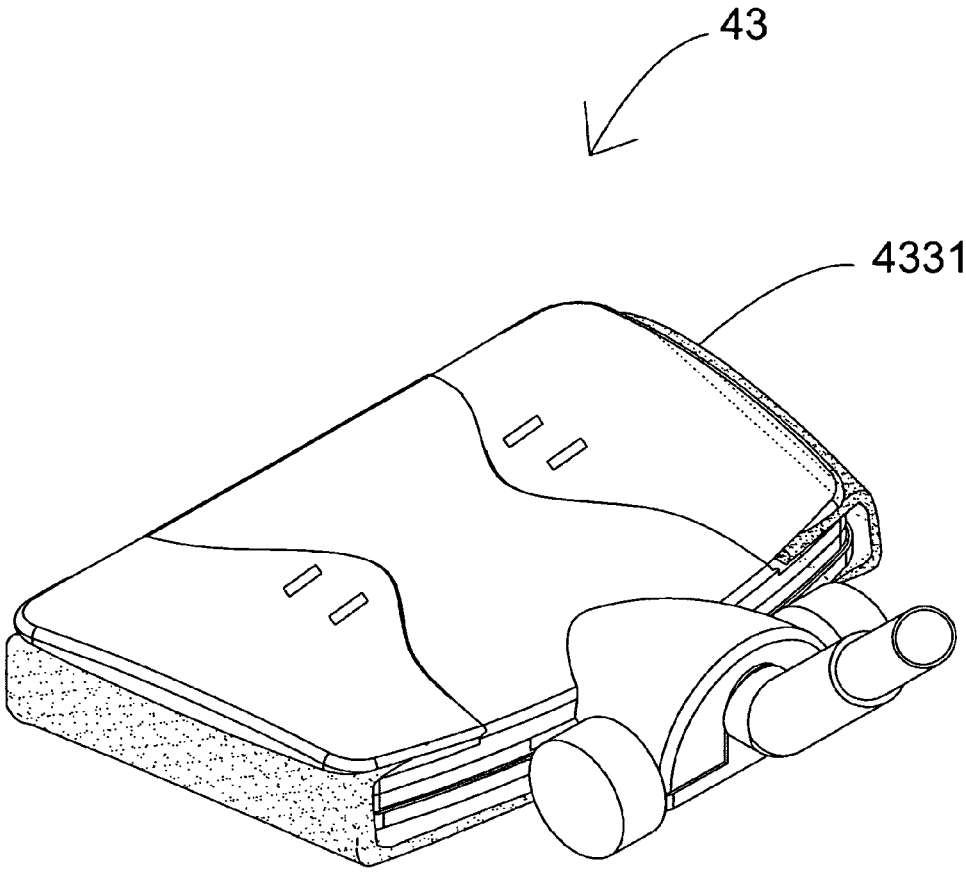
FIG. 11 is a view of clips' clamping ion of a platform cleaning polygon housing of the first embodiment according to the invention.

With reference to FIG. 10, two steam-jetting holes 4322 deposed in a steam-releasing apparatus 4321 located at the undersurface of the tetragonal lower lid 432 can direct the steam released from high temperature resistant chamber 4325 out to the air. A centrally tetragonal indentation is made on the undersurface of the tetragonal lower lid 43 to collect the jet out steam. Two pillar structures 4323 are mounted on the central tetragonal indentation. A plurality of grooves 4324 is disposed on the bottom of the tetragonal lower lid 43. A removable brush-implanted apparatus 435 is adapted into the platform cleaning polygon housing 43 to increase clean functionality.

Referring to FIG. 12, illustrating the cleaning tools engaged to the hand-held steam generator of the invention. The cleaning tools could be a jetting nozzle 51, a circular brush 511, a triangular brush 512 a glass scraper 52, an implanted brush 53, the circular brush collocated to a jetting nozzle 51, or the triangular brush 512 collocated to a jetting nozzle 51.

Various embodiments and changes may be made thereunto without departing from the broad spirit and scope of the invention. The above-described embodiment is intended to illustrate the present invention, not to limit the scope of the present invention.

The scope of the present invention is shown by the attached claims rather than the embodiment. Various modifications made within the meaning of an equivalent of the claims of the invention and within the claims are to be regarded to be in the scope of the present invention.

What is claimed is:

1. An improved steam cleaning device, comprising:
- a hand-held steam generator;
- a pole;
- a polygon-shaped cleaning housing, constructed by an upper lid and a lower lid opposite to each other;
- a steam-releasing apparatus disposed at a bottom of the cleaning housing;
- clips pivotally connected to indentations of the upper lid;
- at least one wheeled body connected to lift said cleaning housing off the floor; and
- a cleaning tool, selected from one of a nozzle, a circular brush, a triangular brush, a scraper, or an implanted apparatus;
- wherein said hand-held steam generator can be selectively adapted to the pole, the cleaning housing or the cleaning tool.

2. An improved steam cleaning device comprising:
- a hand-held steam generator;
- a liquid reservoir knob and a steam adjustment knob deposed on a shelf of the hand-held steam generator, the liquid reservoir knob being utilized to regulate an amount of liquid input, and the steam adjustment knob being employed to adjust a steam-jetting amount.
- a pole;
- a polygon-shaped cleaning housing, constructed by an upper lid and a lower lid opposite to each other;
- a steam-releasing apparatus disposed at a bottom of the cleaning housing;
- clips pivotally connected to indentations of the upper lid;
- at least one wheeled body connected to lift said cleaning housing off the floor; and
- a cleaning tool;
- wherein said hand-held steam generator can be selectively adapted to the pole, the cleaning housing or the cleaning tool.

3. The improved steam cleaning device of claim 2, wherein a rate of said steam-jetting amount ranges from 24±5 CC/min to 45.0±5 CC/min.

4. An improved steam cleaning device comprising:
- a hand-held steam generator;
- a pole;
- a polygon-shaped cleaning housing, constructed by an upper lid and a lower lid opposite to each other, the cleaning housing being engaged to the hand-held steam generator by one pivotal shaft;
- clips pivotally connected to indentations of the upper lid;
- at least one wheeled body connected to lift said cleaning housing off the floor; and
- a cleaning tool;
- wherein said hand-held steam generator can be selectively adapted to the pole, the cleaning housing or the cleaning tool.

5. The improved steam cleaning device of claim 1, wherein the cleaning housing is triangular or tetragonal.

6. The improved steam cleaning device of claim 5, wherein three jetting holes are disposed on the steam-releasing apparatus of the cleaning housing.

7. The improved steam cleaning device of claim 5, wherein two jetting holes are disposed on the steam-releasing apparatus of the cleaning housing.

8. The improved steam cleaning device of claim 5, wherein a polygonal indentation is disposed on an undersurface of the lower lid to collect a jet out steam.

9. The improved steam cleaning device of claim 8, wherein at least one pillar structure is disposed inside the polygonal indentation to orientate the jet out steam.

10. An improved steam cleaning device, comprising:
- a hand-held steam generator;
- a liquid reservoir knob and a steam adjustment knob deposed on a shelf of the hand-held steam generator, the liquid reservoir knob being utilized to regulate an amount of liquid input, and the steam adjustment knob being employed to adjust a steam-jetting amount;
- a pole;

a ploygon-shaped cleaning housing, comprising at least four parts:

an upper lid, a lower lid disposed opposite to the upper lid, clips, and wheeled bodies, a steam-releasing apparatus disposed at a bottom of the cleaning housing, indentations of the upper lid being pivotally connected to the clips, at least one of the wheeled bodies being adapted to lift said cleaning housing off the floor, a plurality of tack bunches being located on the indentations of the upper lid and on a bottom of the clips to secure an absorbent cloth; and a cleaning tool;

wherein said hand-held steam generator is selectively adaptable to the pole, the cleaning housing or the cleaning tool.

11. The improved steam cleaning device of claim 1, wherein the cleaning housing is triangular or tetragonal, wherein at least one jetting hole is disposed on the steam-releasing apparatus, and a polygonal indentation is disposed on an undersurface of the lower lid to collect a jet out steam.

12. The improved steam.cleaning device of claim 2, wherein the cleaning housing is triangular or tetragonal, wherein at least one jetting hole is disposed on the steam-releasing apparatus, and a polygonal indentation is disposed on an undersurface of the lower lid to collect a jet out steam.

13. The improved steam cleaning device of claim 4, wherein the cleaning housing is triangular or tetragonal, wherein at least one jetting hole is disposed on the steam-releasing apparatus, and a polygonal indentation is disposed on an undersurface of the lower lid to collect a jet out steam.

14. The improved steam cleaning device of claim 10, wherein the cleaning housing is triangular or tetragonal, wherein at least one jetting hole is disposed on the steam-releasing apparatus, and a polygonal indentation is disposed on an undersurface of the lower lid to collect a jet out steam.

* * * * *